United States Patent [19]

Hasegawa

[11] Patent Number: 4,621,600

[45] Date of Patent: Nov. 11, 1986

[54] FUEL SUPPLY CONTROL METHOD FOR INTERNAL COMBUSTION ENGINES AT FUEL CUT OPERATION

[75] Inventor: Shumpei Hasegawa, Niiza, Japan

[73] Assignee: Honda Giken Kogyo Kabushiki Kaisha, Tokyo, Japan

[21] Appl. No.: 773,097

[22] Filed: Sep. 4, 1985

Related U.S. Application Data

[63] Continuation of Ser. No. 521,612, Aug. 8, 1983, abandoned.

[30] Foreign Application Priority Data

Aug. 18, 1982 [JP] Japan ..... 57-143010

[51] Int. Cl.[4] ..... F02M 39/00

[52] U.S. Cl. ..... 123/357; 123/198 DB; 123/198 D

[58] Field of Search ..... 123/198 D, 198 DB, 357, 123/358, 359

[56] References Cited

U.S. PATENT DOCUMENTS 4,366,794 1/1983 Hachiga ..... 123/198 DB
4,423,485 12/1983 Sami ..... 123/357
4,425,889 1/1984 Hachitani ..... 123/357

FOREIGN PATENT DOCUMENTS 2062291 5/1981 United Kingdom ..... 123/357

OTHER PUBLICATIONS

Patents Abstracts of Japan—M-34—Sep. 30, 1984—vol. 34/No. 139.

*Primary Examiner*—Carl Stuart Miller
*Attorney, Agent, or Firm*—Lyon & Lyon

[57] ABSTRACT

In a method for electronically controlling the fuel supply to an internal combustion engine in response to operating conditions of the engine, fuel quantities are summed up, which are supplied to the engine after fulfillment of a predetermined condition for cutting off the fuel supply to the engine which is determined by engine operation parameters indicative of operating conditions of the engine, and when the sum of the fuel quantities exceeds a predetermined value, the fuel supply to the engine is cut off, thereby preventing deterioration of the driveability of the engine, burning of a catalyst provided in the engine for purifying exhaust gases, etc. at fuel cut operation of the engine.

6 Claims, 5 Drawing Figures

INTAKE PIPE ABSOLUTE PRESSURE

FUEL SUPPLY CONTROL METHOD FOR INTERNAL COMBUSTION ENGINES AT FUEL CUT OPERATION

This application is a continuation of application Ser. No. 521,612, filed Aug. 8, 1983, now abandoned.

BACKGROUND OF THE INVENTION

This invention relates to a fuel supply control method for internal combustion engines, and more particularly to a method of this kind in which cutting-off of the fuel supply to the engine is effected at appropriate times so as to avoid deterioration of the driveability of the engine, burning of an exhaust gas-purifying catalyst provided in the engine, etc. which would otherwise be caused by cutting-off of the fuel supply to the engine.

In internal combustion engines in general, the supply of fuel to the engine is cut off (hereinafter abbreviated as "fuel cut") while the engine is decelerating in a predetermined operating condition, so as to improve the fuel consumption and emission characteristics of the engine as well as burning of a catalyst provided in the exhaust system of the engine for purifying the exhaust gases.

However, if the fuel cut is frequently effected, there can occur fluctuations in the driving torque of the engine, impeding smooth operation of the engine and giving an unpleasant feeling of shock to the driver or the passenger in the vehicle.

In an attempt to avoid such disadvantages and obtain smooth operation of the engine at decelerating fuel cut, it has been proposed by Japanese Provisional Patent Publication (Kokai) No. 56-50232 to delay effecting the fuel cut by a predetermined period of time after fulfillment of a fuel cut condition, and it has also been proposed by Japanese Provisional Patent Publication (Kokai) No. 54-45423 to delay effecting the fuel cut while the engine is operating in a predetermined speed region.

However, according to the former proposal, the fuel cut is delayed by the same predetermined period of time irrespective of the rotational speed of the engine. As a result, if the delaying period of time is set at a large value in order to avoid an unpleasant feeling of shock at fuel cut at a low rotational speed of the engine, a number of times of fuel injections take place before the lapse of the delaying period of time at a high rotational speed of the engine, which results in supply of an excessive amount of fuel to the engine, causing burning of the catalyst due to reaction with an excessive amount of unburned fuel in the exhaust gases. On the other hand, according to the latter proposal, when the engine is operating in a high speed region, fuel cut is effected immediately upon fulfillment of a predetermined fuel cut condition without delay. This reduces the possibility of burning of the catalyst. However, from the view point of improving the driveability through mitigation of a shock at fuel cut in a high engine speed region, it is not desirable to effect the fuel cut immediately upon fulfillment of the fuel cut condition without delay when the engine is operating in the high engine speed region. Furthermore, protection of the catalyst from burning will be possible by setting the delaying period of time within a range of values at which there is little possibility of burning of the catalyst at high rotational speeds of the engine.

SUMMARY OF THE INVENTION

It is the object of the invention to provide a fuel supply control method for an internal combustion engine, which is adapted to effect the fuel cut at such an appropriate time as to avoid deterioration of the driveability of the engine which would otherwise be caused by fuel cut, as well as to avoid burning of the catalyst over substantially the whole engine rotational speed region, which is apt to be caused by delaying the fuel cut.

According to the invention, there is provided a fuel supply control method for an internal combustion engine, which is characterized by the following steps: (a) setting beforehand a predetermined fuel cut condition for cutting off the supply of fuel to the engine, on the basis of a value of at least one predetermined parameter indicative of operating conditions of the engine; (b) detecting the value of the predetermined parameter; (c) determining whether or not the above fuel cut condition has been fulfilled, from the detected value of the at least one predetermined parameter; (d) when fulfillment of the fuel cut condition is determined in the step (c), calculating the sum of fuel quantities supplied to the engine after the determination of fulfillment of the fuel cut condition; (e) determining whether or not the calculated sum of fuel quantities exceeds a predetermined value; and (f) cutting off the supply of fuel to the engine when it is determined in the step (e) that the calculated sum of fuel quantities exceeds the predetermined value.

The above predetermined value of the calculated sum of fuel quantities is set to a value dependent upon operating conditions of the engine. Preferably, it is set to a value dependent upon the rotational speed of the engine in a manner such that it is set to smaller values as the rotational speed of the engine increases.

The above and other objects, features and advantages of the invention will be more apparent from the ensuing detailed description taken in conjunction with the accompanying drawings.

DETAILED DESCRIPTION

The method according to the invention will now be described in detail with reference to the drawings.

Figure 1:
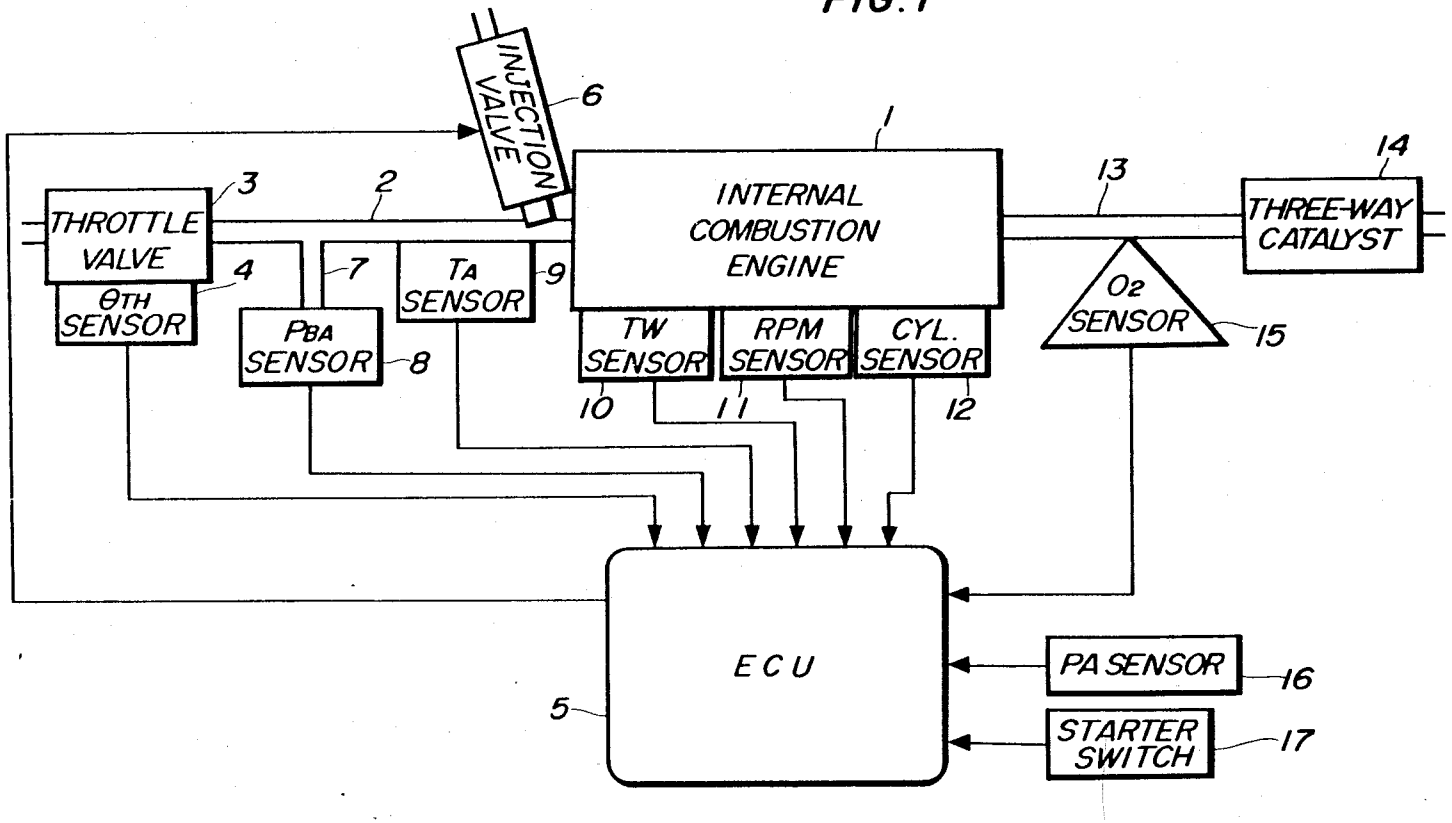
FIG. 1 is a block diagram of an example of a fuel supply control system for an internal combustion engine, to which is applicable the method according to the invention.

Referring first to FIG. 1, there is illustrated the whole arrangement of a fuel supply control system for an internal combustion engine, to which the method of the present invention is applicable. Reference numeral 1 designates a multi-cylinder type internal combustion engine which may have four cylinders, for instance. An intake pipe 2 is connected to the engine 1, in which is arranged a throttle valve 3. A throttle valve opening sensor 4 is connected to the throttle valve 3 for detecting its valve opening and converting same into an electrical signal which is supplied to an electronic control unit (hereinafter called "the ECU") 5.

Fuel injection valves 6, only one of which is shown, are arranged in the intake pipe 2 at a location between the engine 1 and the throttle valve 3. The fuel injection valves 6 are each arranged in the intake pipe 2 at a location slightly upstream of an intake valve, not shown, of a corresponding engine cylinder, and connected to a fuel pump, not shown. Further, the fuel injection valves 6 are electrically connected to the ECU 5 in a manner having their valve opening periods or fuel injection quantities controlled by signals supplied from the ECU 5.

On the other hand, an absolute pressure sensor 8 communicates through a conduit 7 with the interior of the intake pipe 2 at a location immediately downstream of the throttle valve 3. The absolute pressure sensor 8 is adapted to detect absolute pressure in the intake pipe 2 and applies an electrical signal indicative of detected absolute pressure to the ECU 5. An intake air temperature sensor 9 is arranged in the intake pipe 2 at a location downstream of the absolute pressure sensor 8, for detecting the temperature of the intake air in the intake pipe 2, and is electrically connected to the ECU 5 for supplying an electrical signal indicative of the detected intake air temperature to the ECU 5.

An engine coolant temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine speed sensor (hereinafter called "the Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further electrically connected to the ECU 5 are an atmospheric pressure sensor 16 and a starter switch 17 for switching on and off a starter, not shown, of the engine, for supplying respective signals indicative of detected atmospheric pressure and on-state and off-state positions of the starter switch to the ECU 5.

The ECU 5 operates on the values of the above various engine parameter signals to determine operating conditions of the engine including a fuel cut condition, and calculate the fuel injection period TOUT for the fuel injection valves 6 by the use of the following equation:

$$TOUT = Ti \times K1 + K2 \quad (1)$$

where Ti represents a basic value of the fuel injection period which is calculated as a function of intake pipe absolute pressure PB and engine rpm Ne, and K1, K2 represent correction coefficients and correction variables, respectively, values of which are calculated in response to values of output signals from the aforementioned various sensors, that is, the throttle valve opening sensor 4, the intake pipe absolute pressure sensor 8, the intake air temperature sensor 9, the engine water temperature sensor 10, the Ne sensor 11, the cylinder-discriminating sensor 12, the $O_2$ sensor 15, the atmospheric pressure sensor 16, and the starter switch 17, by the use of respective equations, so as to achieve optimum operating characteristics of the engine such as startability, emission characteristics, fuel consumption and accelerability.

The ECU 5 operates on values of the fuel injection period TOUT calculated as above to supply driving signals to the fuel injection valves 6 to energize same.

Figure 2:
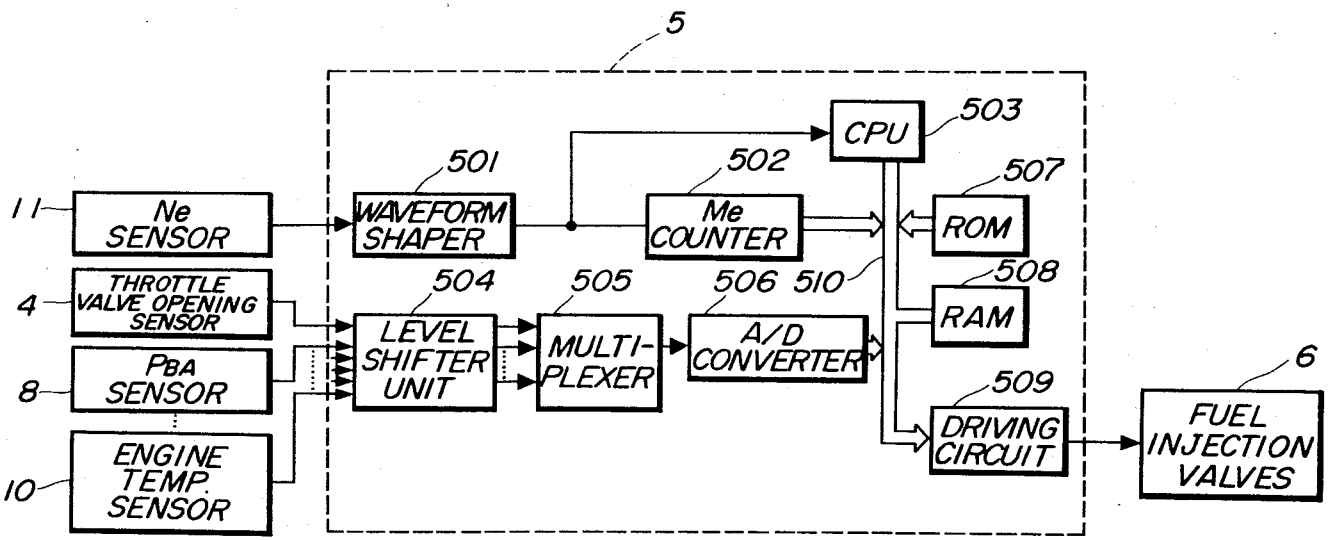
FIG. 2 is a block diagram of a circuit configuration within the electronic fuel control unit (ECU) in FIG. 1.

FIG. 2 shows a circuit configuration within the ECU 5 in FIG. 1. An output signal from the Ne sensor 11 in FIG. 1 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the Ne sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the absolute pressure sensor 8, the engine coolant temperature sensor 10, etc. have their voltage levels successively shifted to a predetermined voltage level by a level shifter unit 504 and applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program executed within the CPU 503 as well as maps of values of the basic fuel injection period Ti for the fuel injection valves 6, a table of predetermined fuel cut-determining values and an Ne-TFCi table, hereinafter referred to, etc. The CPU 503 executes the control program stored in the ROM 507 in synchronism with generation of pulses of the TDC signal to calculate the fuel injection period TOUT for the fuel injection valves 6 in response to values of the various engine operation parameter signals, and supplies the calculated value of fuel injection period to the driving circuit 509 through the data bus 510. The driving circuit 509 supplies driving signals corresponding to the above calculated TOUT value to the fuel injection valves 6 to drive same.

Figure 3:
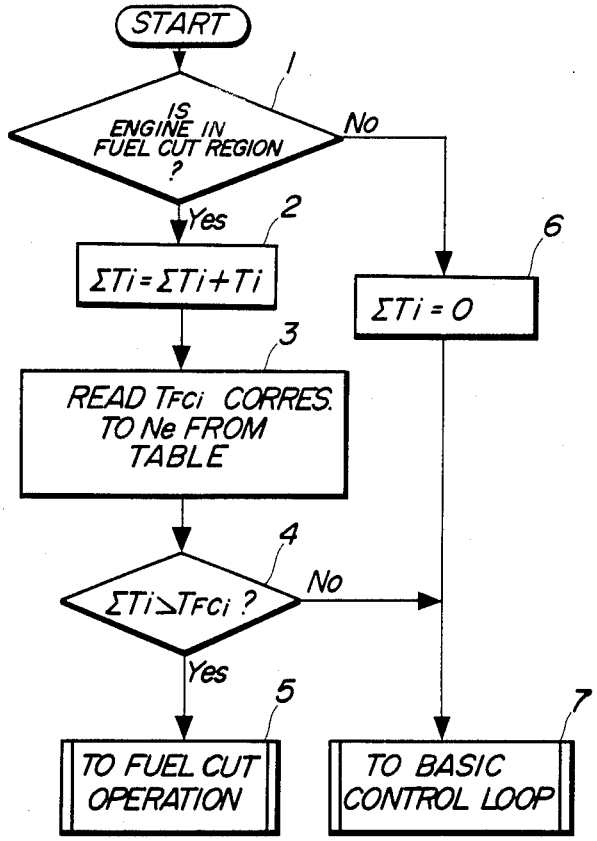
FIG. 3 is a flow chart showing the method according to the invention.
Figure 4:
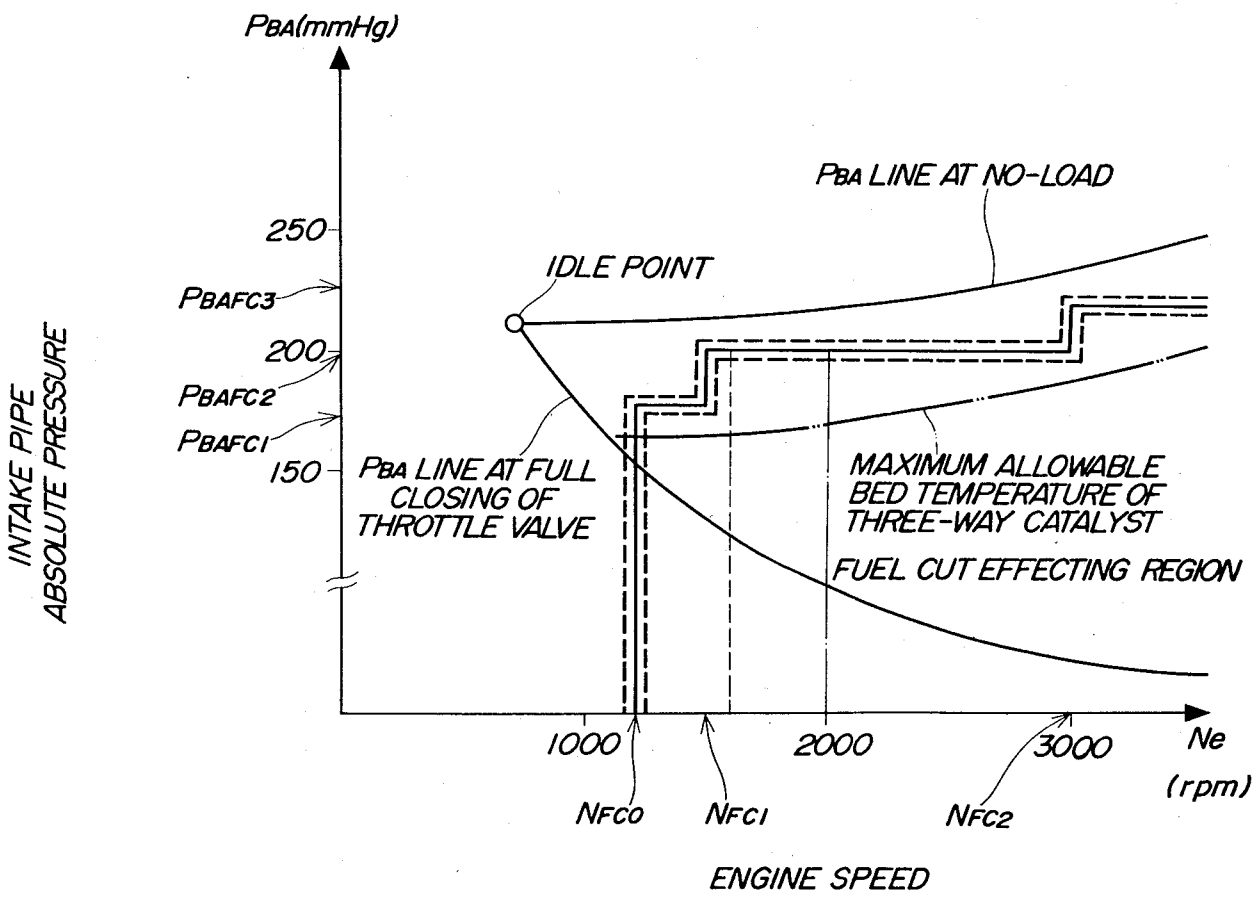
FIG. 4 is a graph showing an example of manner of setting a fuel cut effecting region of the engine.

FIG. 3 shows a flow chart of a subroutine of the method of the present invention, which is executed within the ECU 5 in synchronism with generation of pulses of the TDC signal. First, it is determined at the step 1 whether or not the engine is operating in a predetermined fuel cut effecting region. This fuel cut effecting region is determined by a value of at least one parameter indicative of operating conditions of the engine, for instance values of the engine rpm Ne and the intake pipe absolute pressure PBA as shown in FIG. 4. As shown in FIG. 4, the fuel cut determining absolute pressure PBAFCj (j=1, 2, 3) is set at values falling within a range between an absolute pressure PBA line assumed with no load on the engine when the accelerator pedal is stepped on with the clutch disengaged or with the transmission of the engine in its neutral position, and an absolute pressure PBA line assumed with the throttle valve in its fully closed position, as well as at values exceeding an absolute pressure PBA line corresponding to the maximum allowable bed temperature of the three-way catalyst 14 below which the temperature of the three-way catalyst rises to an abnormal extent. If the fuel cut determining absolute pressure PBAFCj is set along a line intersecting with the absolute pressure PBA line at no engine load, fuel cut can take place during no-load operation of the engine so that the engine torque increases and decreases repeatedly, to cause hunting in the engine speed, resulting in deterioration of the driveability. Also, with an increase in the engine speed, the amount of exhaust gases flowing into the three-way catalyst per unit time increases even when the absolute pressure PBA remains unchanged. As a result, the amount of detrimental ingredients, particularly unburned fuel for reaction in the catalyst per unit time increases so that the temperature of the three-way catalyst can reach the burning point thereof sooner. Therefore, it is necessary to set the fuel cut determining absolute pressure PBAFCj so as to increase with the increase of the engine speed Ne in order to keep the amount of exhaust gas ingredients for reaction in the catalyst per unit time below an allowable upper limit. Thus, the fuel cut effecting region becomes larger in area toward higher engine rotational speeds. The above increasing rate of the fuel cut determining absolute pressure PBAFCj depends upon the cooling degree of the catalyst. Further, it is desirable to set the fuel cut determining absolute pressure PBAFCj at such a low value as can keep the fuel consumption to a minimum but not spoil the driveability.

In view of the above requirements, in the example shown in FIG. 4, two predetermined engine rpm values NFCB1 (1500 rpm) and NFCB2 (3000 rpm) are provided, while the fuel cut determining absolute pressure PBAFCj is set at predetermined values PBAFC1 (180 mmHg), PBAFC2 (200 mmHg) and PBAFC3 (220 mmHg).

On the other hand, the fuel cut determining engine rpm NFCO should desirably be set at values dependent upon the engine coolant temperature TW in such a manner that it is set to a higher value when the engine coolant temperature TW is low, so as to avoid engine stall which is likely to take place upon disengagement of the clutch of the engine immediately after fuel cut, while it is set to a lower value when the engine coolant temperature TW is high, so as to improve the fuel consumption. In the example of FIG. 4, the fuel cut determining engine rpm NFCO is set to 2000 rpm at a value of the engine coolant temperature TW below 20° C., 1600 rpm at 20°–50° C., and 1200 rpm at a value of the temperature TW above 50° C. Thus, the fuel cut effecting region becomes smaller in area as the engine coolant temperature decreases.

Figure 5:
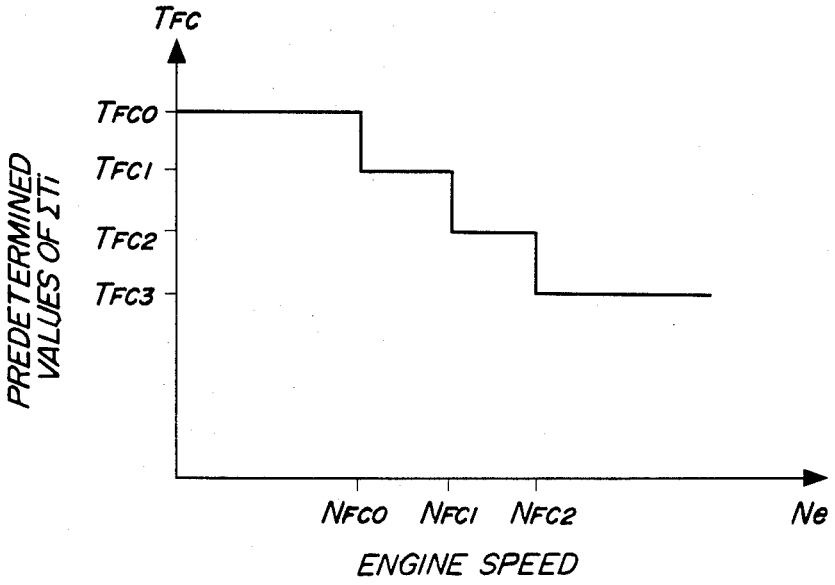
FIG. 5 is a graph plotting predetermined values of the calculated sum of fuel quantities with respect to the rotational speed of the engine.

Reverting to FIG. 3, if the answer to the question of the step 1 is yes, that is, if the engine is operating in the fuel cut effecting region, a basic value Ti of the fuel injection period for each fuel injection valve 6, which has been calculated from detected values of the engine rpm Ne and the intake pipe absolute pressure PBA as previously stated, is added to a calculated sum ΣTi of basic values Ti supplied to the engine, which has been obtained in the preceding loop of execution of the subroutine after fulfillment of the fuel effecting condition has been determined for the first time at the step 1 (step 2). This injection period basic value Ti is read as a map value from the ROM 507 in FIG. 2 each time a pulse of the TDC signal is generated. Then, a predetermined value TFCi which corresponds to a detected value of the engine rpm Ne is selectively read from a predetermined table, at the step 3, for comparison with the calculated sum ΣTi of fuel injection period basic values Ti obtained at the step 2, as hereinafter described. The above predetermined value TFCi is set at values of injection period corresponding to maximum allowable fuel injection quantities which can be supplied to the engine after fulfillment of the fuel cut effecting condition, without causing burning of the three-way catalyst 14 in FIG. 1. For example, it is set at values below 500 ms. The predetermined value TFCI should desirably be set to smaller values as the engine rpm Ne increases, for the following reason: While the engine is operating in a high rotational speed region, the amount of unburned fuel per unit time can be larger than when the engine is operating in a low rotational speed region, even if the same fuel injection quantity is supplied to the engine in both the rotational speed regions. Therefore, in the high rotational speed region, the temperature of the catalyst can be higher than in the low rotational speed region, so that burning of the catalyst can take place even with a smaller fuel injection quantity, i.e. a shorter fuel injection period than in the low rotational speed region. In the example of FIG. 5, the predetermined value TFCi is set to stepwise increased predetermined values TFC0–TFC3 as the engine rotational speed Ne increases from a lower predetermined value NFC0 to a higher one NFC2.

Then, it is determined at the step 4 whether or not the calculated sum ΣTI of fuel injection period values Ti applied after fulfillment of the fuel cut effecting condition exceeds the read predetermined value TFCi (i=0, 1, 2, 3). If as a result of the determination of the step 4 the calculated sum ΣTi is smaller than the read predetermined value TFCi, the program proceeds to execution of a basic control loop at the step 7, without effecting a fuel cut operation. In this basic control loop, values of the aforementioned correction coefficients K1 and correction variables K2 are calculated from detected values of the aforementioned various engine operation parameters, to calculate a value of the fuel injection period TOUT from the calculated values of K1 and K2 and the basic injection period value Ti read from the ROM 507, for energization of the fuel injection valves 6 with a duty factor corresponding to the calculated fuel injection period TOUT to supply fuel to the engine. If the answer to the question to the step 4 is yes, that is, if it is determined at the step 4 that the calculated sum Ti exceeds the predetermined value TFCi, the fuel cut operation is effected at the step 5. That is, the fuel injection period TOUT is set to zero to cut off the fuel supply to the engine.

On the other hand, if the answer to the question of the step 1 is no, that is, if the engine is not operating in the fuel cut effecting region, the calculated sum ΣTi of fuel injection period values Ti obtained in the last loop is set to zero at the step 6, followed by execution of the basic control loop at the step 7.

Although in the foregoing embodiment the sum of fuel injection period values applied immediately after fulfillment of the fuel cut condition is obtained from basic values Ti of fuel injection period read from a map in the ROM 507, it may alternatively be obtained from calculated fuel injection period values TOUT. Further, in an engine equipped with main fuel injection valves and a sub injection valve as the fuel injection valves 6, values read from maps for these two kinds of valves may be used for calculating the sum of fuel injection period values applied immediately after fulfillment of the fuel cut condition. Still further, in lieu of the fuel injection period values, actual fuel injection quantities may be detected so that when the sum of detected values of fuel injection quantities exceeds a predetermined value, the fuel cut operation is effected.

The predetermined fuel cut determining values PBAFCj and NFC0 of intake pipe absolute pressure and engine rpm may be provided with hysteresis margins of ±15 mmHg and ±25 rpm with respect to respective basic values thereof, as indicated by the dotted lines in FIG. 4 so that the fuel cut operation is initiated and terminated at different values of intake pipe absolute pressure and engine rpm, thereby substantially absorbing shocks at entrance into and departure from the fuel cut effecting region and therefore ensuring smooth operation of the engine.

What is claimed is:

1. A method for electronically controlling the quantity of fuel being supplied through injection to an internal combustion engine in synchronism with generation of pulses of a predetermined control signal, in response to operating conditions of said engine, said engine having an exhaust passage and a catalyst device arranged in said exhaust passage for purifying exhaust gases, the method comprising the steps of: (a) setting beforehand a predetermined fuel cut condition for cutting off the supply of fuel to said engine during deceleration, on the basis of the maximum allowable bed temperature of said catalyst device which is a function of the rotational speed of said engine and a predetermined parameter indicative of load on said engine; (b) detecting the rotational speed of said engine; (c) detecting the value of said predetermined parameter; (d) determining whether or not said predetermined fuel cut condition has been fulfilled, from the detected values of the engine rotational speed and said predetermined parameter; (e) when fulfillment of said predetermined fuel cut condition is determined in said step (d), calculating the sum of fuel injection quantities supplied to said engine upon generation of each pulse of said predetermined control signal after fulfillment of said predetermined fuel cut condition has been determined; (f) determining whether or not the calculated sum of fuel injection quantities exceeds a predetermined value corresponding to the maximum allowable fuel quantity that can be supplied to said engine per unit time so as to maintain the bed temperature of said catalyst device below said maximum allowable bed temperature; and (g) cutting off the supply of fuel to said engine when it is determined in said step (f) that the calculated sum of fuel injection quantities exceeds said predetermined value.

2. A method as claimed in claim 1, wherein said steps (d), (e) and (f) comprise calculating the sum of fuel injection periods through which fuel has been supplied to said engine after said determination of fulfillment of said predetermined fuel cut condition, determining whether or not the calculated sum of fuel injection periods exceeds a predetermined value, and cutting off the supply of fuel when the calculated sum of fuel injection periods exceeds said predetermined value.

3. A method as claimed in claim 1, wherein said engine includes an intake passage, and said predetermined parameter is indicative of absolute pressure within said intake passage of said engine.

4. A method as claimed in claim 3, wherein it is determined that said predetermined fuel cut condition is fulfilled when a detected value of the absolute pressure within said intake passage is smaller than a predetermined value which increases as the rotational speed of said engine increases.

5. A method as claimed in claim 1, wherein said predetermined value of the sum of fuel quantities is set to a value dependent upon operating conditions of said engine.

6. A method as claimed in claim 5, wherein said predetermined value of the sum of fuel quantities is set to a value dependent upon the rotational speed of said engine in a manner such that it is set to smaller values as the rotational spped of said engine increases.

* * * * *